US007896102B2

(12) United States Patent
Hirling et al.

(10) Patent No.: US 7,896,102 B2
(45) Date of Patent: Mar. 1, 2011

(54) PNEUMATIC DRIVE SYSTEM

(75) Inventors: Ulrich Hirling, Denkendorf (DE); Ute Casimir, Esslingen (DE)

(73) Assignee: Festo AG & Co. KG, Esslingen (DE)

( * ) Notice: Subject to any disclaimer, the term of this patent is extended or adjusted under 35 U.S.C. 154(b) by 344 days.

(21) Appl. No.: 12/223,101

(22) PCT Filed: Feb. 21, 2006

(86) PCT No.: PCT/EP2006/001538

§ 371 (c)(1),
(2), (4) Date: Jul. 22, 2008

(87) PCT Pub. No.: WO2007/095964

PCT Pub. Date: Aug. 30, 2007

(65) Prior Publication Data

US 2010/0276171 A1 Nov. 4, 2010

(51) Int. Cl.
*F15B 11/042* (2006.01)

(52) U.S. Cl. ..... 173/206; 173/47; 173/168

(58) Field of Classification Search ..... 173/206, 173/207, 208, 168, 169, 177, 2, 17, 47
See application file for complete search history.

(56) References Cited

U.S. PATENT DOCUMENTS

| | | | | |
|---|---|---|---|---|
| 4,840,236 | A * | 6/1989 | Goldman | 173/206 |
| 6,334,495 | B2 * | 1/2002 | Deimel et al. | 173/207 |
| 6,557,647 | B2 * | 5/2003 | White | 173/17 |
| 6,672,403 | B2 * | 1/2004 | Ahr et al. | 173/1 |
| 6,698,532 | B2 * | 3/2004 | Gotou et al. | 173/206 |
| 6,981,558 | B2 * | 1/2006 | Riedl | 173/49 |

FOREIGN PATENT DOCUMENTS

| | | |
|---|---|---|
| DE | 3118764 A1 | 3/1983 |
| EP | 0771396 | 7/2003 |
| WO | WO 02/14698 | 2/2002 |

* cited by examiner

*Primary Examiner* — Scott A. Smith
(74) *Attorney, Agent, or Firm* — Hoffman & Baron, LLP

(57) ABSTRACT

A pneumatic drive system (1) in which the movement of an output drive unit (7) of a pneumatic drive (2) is controlled by a control valve (25 and 26) which is connected with the working chambers (12 and 13) of the pneumatic drive (2). The control valve (25 and 26) comprises least one air economy setting (30) setting a choke cross section and a high power setting (29) defining a flow cross section larger than it. An actuator serves to ensure that the control valve is switched over, in a fashion dependent on the air pressure obtaining in the at least one working chamber (12 and 13) from the normally assumed air economy setting (30) into the high power setting (29), when the output drive unit (7) meets with an increased resistance to motion.

14 Claims, 1 Drawing Sheet

PNEUMATIC DRIVE SYSTEM

This application claims priority based on an International Application filed under the Patent Cooperation Treaty, PCT/EP2006/001538, filed Feb. 21, 2006.

BACKGROUND OF THE INVENTION

The invention relates to a pneumatic drive system comprising at least one pneumatic drive having a drive housing and an output drive unit able to be shifted in relation to it by the action of compressed air, said output drive unit possessing an output piston, which in the drive housing divides two working chambers from each other, of which one or both is connected with control valve means serving for the controlled action of compressed air, said control valve means being able to be switched over between several switching settings which include an air economy setting defining a choke cross section.

A pneumatic drive system of this type as disclosed in the patent publication WO 02/14698 A1 is employed for crust breaking applications in aluminum processing. The system comprises a pneumatic drive designed as a crust breaker cylinder, whose output drive unit is able to be driven to perform oscillating working movements, said unit while jabbing through any crust layer, which may have accumulated, being dipped into a bath of molten aluminum for some time. A direction setting valve is responsible for the respective working movements since it controls the supply and venting of compressed air into and from two working chambers separated from each other by the output piston of the output drive unit.

Furthermore double control valve means act on the control means for the compressed air action and are placed on the connection between the direction setting valve and a respective working chamber. These control valve means may assume different switching settings, one switching setting being responsible for causing the working movement by freeing an air passage. In order to minimize use of air this switching setting is designed as an air economy setting since the fluid passage has a choke cross section which only permits a limited passage through it. Accordingly the degree of filling of the connected working chamber remains at the lowest possible level.

If the output drive unit strikes aluminum crust and is therefore subjected to a greater resistance to motion, via the choke cross section an increasing actuating pressure will be gradually built up in the connected working chamber to greater extent until the necessary penetrating force is reached. On arriving in the end of a stroke the output drive unit finally causes a switching over of the control valve means into a locked position in order to avoid further flow of compressed air into the pneumatic drive.

Owing to the time necessary for the build up of pressure in the pneumatic drive, when the output drive unit has to penetrate crust on the melt, there are irregular delays in time in the individual working cycles from case to case.

A similar arrangement is described in the European patent publication EP 0771396 B1. In this case there is also the description of an alternative design with the possibility of doing without a choke in the control lines. This however entails a continuous intense action of compressed air pressure in the working chambers, something which is a disadvantage as regards the consumption of compressed air.

SUMMARY OF THE INVENTION

An important object of the present invention is to suggest measures which allow a reduction in the cycle time without any inordinately increased use of compressed air.

In order to achieve this aim there is a provision such that as a further switching setting the control valve means have a high power setting which sets a flow cross section which is larger than the choke cross section and that the control valve means have actuating means, which during the supply of compressed air into one working chamber so control the switching over of the control valve means connected this working chamber in a fashion dependent on the air pressure obtaining in at least one working chamber that a switching over takes place from the normally assumed air economy setting into the high power setting, when and at least as long as the output drive unit is subjected to a increased resistance to motion.

Accordingly the output drive unit will move as long in the air economy setting as it is not subject to an increased resistance to movement. Owing to the choke cross section then effective the degree of filling of the connected working chamber is restricted to a minimum and consequently the air requirement is also limited. As soon however as an increased resistance to motion applies for the output drive unit, the control valve means responsible for air supply to the respective working chamber will switch back, owing to the change in pressure occurring in the pneumatic drive, into the high power setting and will render possible a more rapid air inflow with an increased flow cross section and accordingly a quick increase in pressure in the connected working chamber. This leads to an increase in the setting force and overcomes the resistance to motion opposing the output drive unit. Following a reduction in the resistance to motion the control valve means may possibly switch back to the air economy setting. Therefore the requirement for a relatively large amount of air only occurs as from or during the operational phase, in which a higher actuating pressure is in fact necessary. In other respects the requirement for air will remain at the choked normal level. Simultaneously the cycle times are also reduced, because the air filling time is substantially shorter in the high power setting than in the air economy setting always maintained in the prior art.

The advantages as described turn out to be quite considerable, if the pneumatic drive system is employed as a crust breaker system in aluminum production or, respectively, processing. Owing to the short operating cycle time the saving of air has proved to be immense. Simultaneously there is if required an increased setting force with only a short delay in order for example to break through an aluminum crust or to strip off solidified aluminum material fouling the output drive unit. Owing to the pressure-controlled actuation there is furthermore the advantage that the build up of pressure in the working chamber responsible for the current working movement occurs in a manner varied to suit the level of the resistance to movement, which is to be overcome. It is therefore possible to ensure that in the high power or high force phase there is always sufficient compressed air in the pneumatic drive as is required for overcoming the resistance to movement which is just current.

Further advantageous developments of the invention are defined in the dependent claims.

Although the principle of the invention may also be applied in rotary and pivotal drives, its employment in linear drives is more especially advantageous.

In the case of the at least one linear drive it is preferably a question of a pneumatic cylinder with a piston rod, which is able to be utilized as a crust breaking cylinder. Use is however not restricted to crust breaker applications.

The actuating means for the control valve means are in particular so designed that they control the switch over operation in a fashion dependent on the air pressure obtaining in the working chamber connected with the control valve means.

On encountering a resistance to motion such air pressure rises and will cause switching over from the air economy setting to the high power setting.

The switching setting of the control valve means is preferably determined by the currently assumed setting of a control valve member of such control valve means. This member is preferably urged toward the air economy setting by the input pressure present (at the input) at the control valve means. The output pressure obtaining at the output side of the control valve means, i.e. on the side of the connected working chamber, acts on the control valve member in the direction opposite to the high power setting. There are also spring means effective in this direction. When the force of the spring means and the setting force resulting for the output pressure are in all greater than the setting force resulting from the input pressure, switching over to the high power setting takes place. If the setting force of the spring means is able to be adjusted or varied, there is the possibility of individual setting of the switch over threshold.

The spring means preferably serve to ensure that in the pressure-less state the control valve means assume the high power setting. If—more particularly via an upstream direction setting valve—the operating pressure is increased, it is possible using a choke means placed on the actuating duct tapping the output pressure, to cause a delayed build up of the setting force resulting from the output pressure so that the control valve means immediately assume the air economy setting.

A further advantage may be produced, if the control valve means have a third switching position, in which the compressed air goes through a flow cross section smaller than the choke's cross section. This switching setting will be termed the hold setting, because it takes effect to hold the output drive unit in its end of stroke position. The hold setting of the control valve means takes effect in a manner dependent on the position of the output drive unit, when the latter gets near or reaches the end of stroke position. Switching over may be caused mechanically, for example owing to a plunger-like setting member cooperating with the output drive unit, or however also electrically using suitable position sensor means. The reduced flow cross section in the hold setting avoids an excessive filling of the connected working chamber compensates simultaneously for any leakage so that the output drive unit is held fast and does not perform any oscillating movements. A design is considered to be optimum in which the flow cross section left free in the hold setting has a size, which taking into consideration the operating pressure present, sets a flow rate which is substantially equal to the leakage in the pneumatic drive. Accordingly the degree of filling with air in the connected working chamber does not increase or only slightly increases, although the air connection is not closed down, as is mandatory in the prior art.

BRIEF DESCRIPTION OF THE DRAWINGS

In the following the invention will be explained with reference to the accompanying drawing. The single FIGURE (FIG. 1) shows the pneumatic drive system as a simplified circuit diagram in a preferred embodiment, which is more particularly but not exclusively suitable for crust breaker applications.

DETAILED DESCRIPTION OF THE PREFERRED EMBODIMENTS

Figure 1:
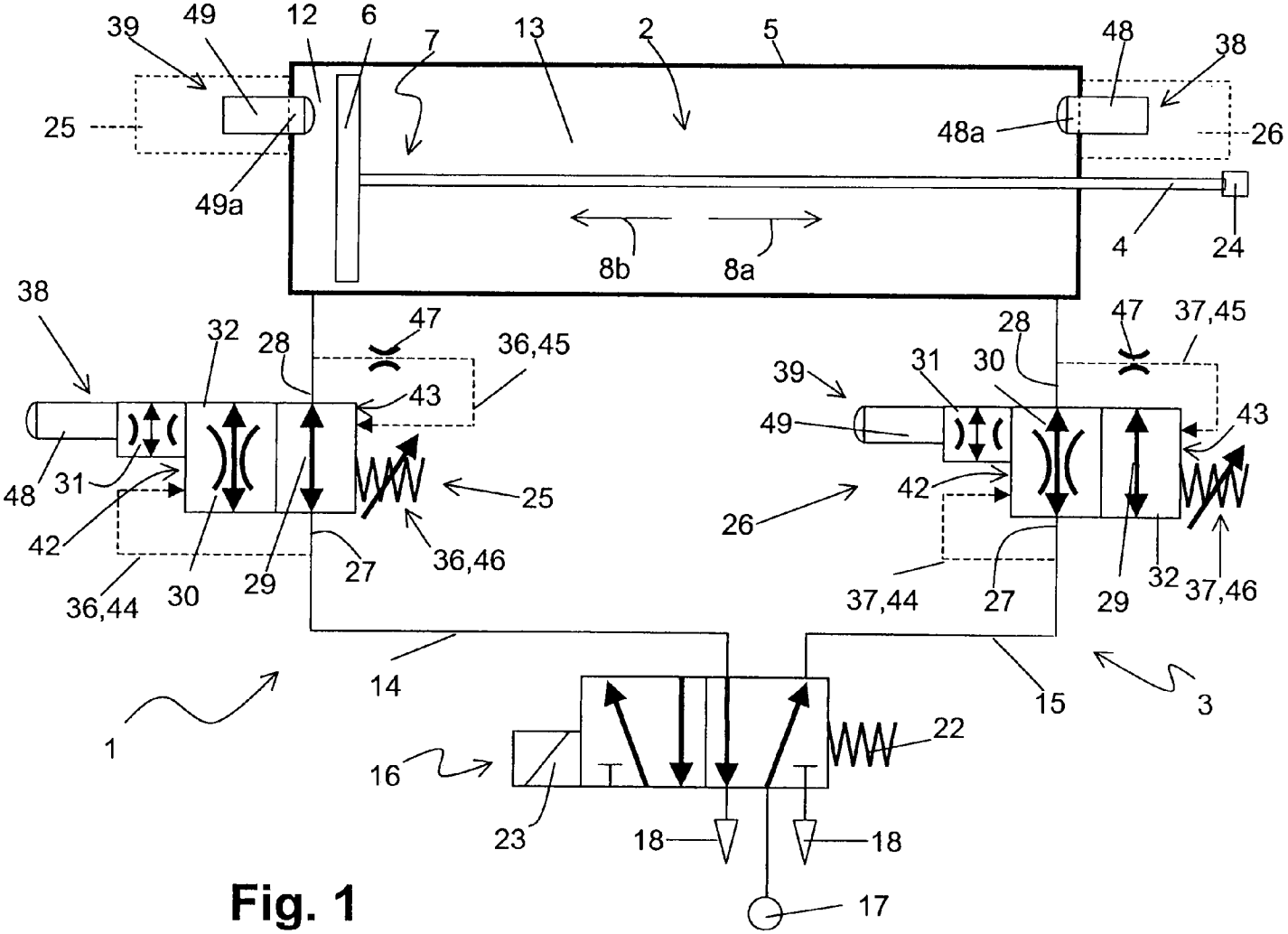

The pneumatic drive system generally referenced 1 comprises at least one pneumatic drive 2 which may conveniently be a linear drive. It is provided with a control means generally referenced 3 serving for control during operation.

The pneumatic drive 2 is in principle of any desired construction. For instance it could be in the form of a linear drive without a piston rod. For instance it can be a pneumatic cylinder having a piston rod 4.

The pneumatic drive 2 includes a housing which is termed the drive housing 5 and has a certain longitudinal extent, in whose internal space a linearly sliding drive piston 6 is located, which is combined with the above mentioned piston rod 4 to constitute a moving unit termed a output drive unit 7. This output drive unit 7 is able to be shifted longitudinally to perform either an outward or an inward working movement 8*a* and 8*b* in relation to the drive housing 2 linearly.

The internal space unit drive housing 5 is divided up by the output drive piston 6 into a first rear working chamber 12 and a second front working chamber 13 having the piston rod 4 extending in it.

The first working chamber 12 is joined to a first fluid control line 14, and the second working chamber 13 is connected with a second fluid control line 15. These two control lines 14 and 15 are also a component of the control means 3 like a direction setting valve 16, with which the two control lines 14 and 15 are connected at their ends remote from the pneumatic drive 2.

By way of the direction setting valve 16 the action of compressed air in the two working chambers 12 and 13 may be controlled in order to cause the currently desired working movement 8*a* and 8*b* of the output drive unit 7. The direction setting valve 16 may connect, dependent on the switching setting assumed by it, either the one (14) or the other (15) control line with a compressed air source 17, while it simultaneously vents the respectively other control line 14 and 15 to the atmosphere 18. The source 17 of compressed air supplies compressed air at a certain operating pressure.

The direction setting valve is in the example a 5/2 directional valve. It is biased by a spring means 22 into a home position as shown in FIG. 1, in which the second control line 15 is connected with the compressed air source 17 and the first control line 14 is vented. By means of an electrical or electromagnetic actuating device 23 the direction setting valve 16 may be switched over into the opposite switching setting.

The direction setting valve 11 may as such be a directly operated or pilot valve. For producing the desired functionality, it may be also made up of several functionally linked individual valves, as for example two 3/2 directional valves.

In a preferred embodiment of application the pneumatic drive 2 is designed in the form of a crust breaker cylinder. In this respect a hammer element 24 is arranged on the end portion, located outside the drive housing 5, which is suitable for breaking through a crust on the surface of an aluminum melt or some other molten metal bath. In this case the pneumatic drive 2 is typically arranged with its longitudinal direction vertical and with the piston rod 4 extending downward. With the output drive unit 7 retracted—this condition is indicated in FIG. 1—the hammer element 24 assumes a position some distance clear of the material crust. For penetrating the crust the output drive unit 7 is driven to perform its extending working movement 8*a*, it dipping into the aluminum melt with the hammer element 24 to the fore so that it breaks through any crust present.

First and second control valve means 25 and 26, which operate separately, are connected with the two working chambers 12 and 13. The first control valve means 25 are placed on the first control line 14 and the second control valve means 26 are placed on the second control line 16. Supplementing the direction setting valve 16 they render possible a particular form of controlled compressed air actuation of the respectively connected working chamber 12 and 13.

The control valve means 25 and 26 respectively possess a valve input 27 connected with the direction setting valve 16 and a valve output 28 connected with the working chamber 12 and 13 to be controlled.

The two control valve means 25 and 26 are able to be switched over between different switching settings. In this respect the two control valve means 25 and 26 may alternatively assume a high power setting 29 29, an air economy setting 30 and a hold setting 31. The FIGURE shows an operating state in which the first control valve means 25 is in the high power setting and the second control valve means 26 is in the air economy setting.

Preferably the two control valve means 25 and 26 are respectively constituted by a control valve, which has a control valve member 32 able to be selectively set in one of three positions, such valve being purely diagrammatically indicated in the drawing. In the case of the control valve member 32 it may be a question of a piston slide or spool for example.

All three switching settings share the feature that they open up a compressed air connection between the direction setting valve 16 and the working chamber 12 and 13 connected therewith. The only difference is the size of the flow cross section made available. The passage of air is not completely shut off in any switching setting.

The flow cross section cleared in the air economy setting 30 will be termed the choke cross section. It is smaller than the rated cross section of the respectively connected control line 14 and 15 and causes a choking of the compressed air flowing through it. If the output drive unit 7 can therefore move without hindrance, there is therefore an output pressure at the valve output 28 which is lower than the supplied operating pressure, such output pressure being present as the current operating pressure in the connected working chamber 12 and 13 as well.

The flow cross section made available in the high power setting 29 is larger than the choke cross section. It renders more especially possible an unchoked access of air and preferably corresponds to the rated cross section of the control lines 14 and 15.

The minimum flow cross section is provided in the hold setting 31. This cross section is even substantially smaller than the choke cross section effective in the air economy setting 30 to be described infra. The two control valve means 25 and 26 are provided with functioning first and, respectively, second actuating means 36 and 37. They are responsible for seeing that the associated control valve means 25 and 26 assume the high power setting 29 or the air economy setting 30. Switching over into the hold setting 31 cannot on the other hand be caused by them.

For the switching over into the hold setting 31 first and second further actuating means 38 and 39 are responsible, which in contradistinction to the completely pressure dependent first and second actuating means 36 and 37 are preferably activated or deactivate completely dependently on the linear position of the output drive unit 7, and they have priority over the first and the second actuating means 36 and 37. When the output drive unit 7 reaches a position relevant for the switching over into the hold setting 31, the switching over operation will occur irrespectively of whether the control valve means 25 and 26 have so far assumed the high power setting 29 or the air economy setting 30.

The first and the second actuating means 36 and 37 are in a position of controlling the switching over of the associated control valve means 25 and 26 in a manner dependent air pressure obtaining in at least one working chamber. The control is on the basis in particular of the pressure which currently obtains in the working chamber 12 and 13 and which in the present case is the same as the output pressure obtaining at the valve output 28. The design is best such that the normally, when the output drive unit 7 is able to move freely, the air economy setting 39 is assumed and starting at this point switching over takes place into the high power setting 29, when the output drive unit 7 in the course of its working motion 8*a* and 8*b* is subject to a higher resistance to motion and accordingly the working pressure then obtaining in the working chamber 12 and 13 just being supplied with compressed air rises to a predetermined switch over threshold.

In order to render this switching over operation possible in a particularly simple manner, each respective control valve member 32 is in the working example provided with two oppositely aligned first and second air action faces 42 and 43.

Action of compressed air on the first actuating face 42 produces a setting force toward the air economy setting and action of air on the second air action face 43 produces a setting force toward the high power setting 29.

The first compressed air actuating face 42 is subjected to the input pressure present at the valve input 27 via a first actuating duct. Via a second actuating duct 45 the second compressed air actuating face 43 is subjected to the output pressure obtaining at the valve output 28. In addition spring means 46 are present, which exert a setting force also effective toward the high power setting on the control valve member 32.

The setting force of the spring means 46 is preferably adjustable, something which is indicated symbolically by an oblique arrow.

On the second actuating duct 45 there is preferably a choke means 47, which causes a time delayed build up of pressure in the second air actuating face 43.

Ignoring the hold setting 31 for the present, more particularly the operation in steps of the pneumatic drive system 1 is possible as explained in the following.

The explanation will begin in a home position with the output drive unit 7 drawn as far as possible into the drive housing 5 and with the system in s pressureless state. In this case the two control valve means 25 and 26—if the further actuating means 38 and 39 were not present—are held by the force of the spring means 46 in the high power setting 29 allowing the maximum flow rate.

Starting at this point the direction setting valve 16 is switched over into the second switching over position (not illustrated) with the compressed air source 17 turned on so that the first control line 14 receives compressed air at the operational pressure level and simultaneously the second control line is vented. The compressed air entering through the first control line 14 will flow through the first control valve means 25 located in the high power setting and will act on the output drive unit 7 in the extension direction so that the unit is driven to perform the outward working movement 8*a*.

The compressed air then expelled by the working piston 6 from the second working chamber 13 then passes by way of the second control valve means 26 held by the spring means 46 in the high power setting also allowing unrestricted passage of air and through the following direction setting valve 16 to the atmosphere 18. Since atmospheric pressure obtains in the control line 15, the switching setting of the second control valve means 26 is not affected during the venting phase.

Directly after the supply of air into the first control, line 14 the first control valve means 25 switch over into the air economy setting 30. This is because the operating pressure so far obtaining in the entire first control line 14 is able to act on the first air actuating face 42 without limitation, at the second air actuating face 43 however owing to the intermediately placed means 47 initially only a low actuating pressure obtains. The design is such that the thrust force applied by way of the first air actuating face 42 toward the air economy setting is greater than the sum of the thrust force acting at the second air actuating face 43 and the setting force of the spring means 46.

Following the switching over into the air economy setting 30 owing to the choke cross section now effective there is an output pressure lower than the output pressure, such output pressure also taking effect in the connected first working chamber 12 where it is responsible for the advance motion of the output drive unit 7.

Even if after a certain time a constant actuating pressure should obtain in the entire second actuating duct, the first control valve means 25 will dwell in the air economy setting, because the design of the first and the second actuating means 36 and 37 is such that the above mentioned actuating pressure corresponding to the valve output pressure to a maximum extent together with the spring means 46 can exert a setting force to a maximum extent, which is under the opposite actuating force on the basis of the valve input pressure.

As long as the output drive unit 7 does not strike any obstacle, it is extended with the reduced output pressure of the first control valve means 25, the degree of filling of the first working chamber 12 being relatively low in accordance with the low output pressure.

When the output drive unit 7 reaches its stroke position at maximum extension, by switching over the direction setting valve 16 it is possible to cause a reversed progression of motion, the second control valve means 26 behaving like the first control valve means 25 did previously and the first control valve means 25 previously behaving like the second control valve means 26 did.

However the operational behavior does change when the output drive unit 7 is subjected to a greater resistance to movement during the one or the other working movement 8*a* and 8*b*. During extension this may be because the hammer element 24 of the output drive unit 7 strikes material crust to be penetrated. During retraction such a resistance may be entailed by solidified materials from the melt, which cling to the extended end section of the piston rod 4.

In the case of such an operating stage the working pressure in the working chamber 12 or 13 presently subject to compressed air will increase. The speed of the increase in pressure is dependent on the size of the choke cross section for the air to flow through.

Since the working pressure effective in the operated working chamber 12 or 13 acts via the second actuating duct on the control valve member 32 as well, the actuating force, effective in the high power setting direction, will at some time exceed the opposite actuating force effective at the first air actuating face 42. The switch over threshold force responsible for the time of switch over may be influenced and set by mutual matching of the area sizes of the two air actuating faces and the setting force of the spring means 46.

In the case of a typical application an operating pressure may be 6 bar, this meaning a working chamber pressure of 2 bar in the air economy setting, the switch over threshold for switching over into the high power setting lying at a working chamber pressure of approximately 2.5 bar.

Owing to the switching over into the high power setting the supplied compressed air has larger flow cross section available for it. Accordingly the working pressure obtaining in the connected working chamber 12 or 13 rises in a short time to a maximum equal to the operating pressure supplied to the control valve means so that the output drive unit 7 is acted on by a considerable fluid setting force, on the basis of which it is able to overcome the resistance to movement, i.e. in the present case for example the material crust to be penetrated.

As soon as the output drive unit 7 may be moved with a lower resistance again, as a rule the pressure in the working chamber will drop again owing to the dynamics of the system so that at the control valve means 32 a new resulting actuating force will become established tending to switch over into the air economy setting and there will be a corresponding switching back into the air economy setting 30.

Even if the control valve means 25 and 26 after switch over to the high power setting cannot be switched into the air economy setting owing to the dynamics of the system while the continued working movement, there is even so a considerable air economy effect, because the switching into the high power setting for the individual working movements always only takes place, when an increased resistance to movement occurs. In many cases this will not be the case so that operation taking full advantage of the air economy function is possible.

Further advantages are possible if the control valve means 25 and 26 render possible the above mentioned additional switching over into a hold setting 31.

For this purpose the further actuating means 38 and 39 are so designed that they shift the control valve means 25 or 26, which currently serve for the supply of compressed air into a working chamber 12 or 13, into a hold setting, which renders possible a reduced flow rate, when the output drive unit 7 reaches an end of stroke position or a position just short of the end of a stroke. Owing to this position-dependent switching over it is possible to ensure that in the end of stroke positions, when the output drive unit 7 is unable to move farther, the compressed air can flow at a further-reduced flow rate into the connected working chamber 12 or 13 as long as the direction setting valve 16 is not switched over.

Owing to the constantly maintained action of compressed air it is possible to achieve the major advantage over a complete turning off that leakages occurring in the system are compensated for and the air pressure existing in the pressurized working chamber normally never falls below a value permitting motion of the output drive unit 7 in relation to the drive housing 5.

This is more particularly relevant in the case of employment as a crust breaker cylinder, when it is a question of securely locking the retracted and therefore elevated output drive unit 7 and preventing even the least downward movement.

Preferably the flow cross section of the control valve means 25 and 26, which is open in the hold setting 31, is so related to the acting operating pressure that the permissible flow rate is at least essentially equal to the leakage occurring in the pneumatic drive 2. Preferably the permitted flow rate is at least equal to or slightly above the leaked flow occurring, which for example takes place between the output piston 6 and the drive housing 5.

For the detection of that axial position of the output drive unit 7, at which the switching over of the control valve means 25 and 26 into the hold setting 31 is to be caused, the further actuating means 38 and 39 are fitted with suitable responsive means 48 and 49. These responsive means 48 and 49 are located preferably on or in the drive housing 5, and in the particular working example are designed to produce a purely mechanical switch over of the control valve means 25 and 26.

For the purpose of mechanical activation they preferably include in each case at least one plunger-like setting member 48*a* and 48*b* which so extends into the path of motion of the output drive unit 7 that it is struck and shifted by it on reaching the desired switching over position.

Preferably the responsive means 48 and 49 are direct components of the control valve means 25 and 26. This opens up the particularly advantageous possibility of installing the control valve means 25 and 26 directly on or in the drive housing 5, as is indicated in chained lines in FIG. 1. For reasons clarity of the drawing the control valve means 25 and 26 are illustrated in FIG. 1 as being separate from the drive housing 5 and the reference numerals 48 and 49 are employed twice to make it clear which responsive means 48 and 49 belong to which control valve means 25 and 26.

A exclusively mechanical switching over offers the advantage that it is possible to do without electrical means. However it would be quite possible to provide the responsive means 48 and 49 in the form of sensors detecting the position of the output drive unit 7 and which on activation produce an electrical sensor signal, on the basis of which an electrical switching over of the control valve means 25 and 26 is caused into the hold setting 31.

At this point it is to be noted that in principle the switching over between the high power setting 29 and the air economy setting 30 can be caused by electrical signals, if the relevant pressure parameters are detected by pressure switches or pressure sensors.

In conjunction with the further actuating means 38 and 39 there is, on starting the above mentioned course of operation, a change such that the output drive unit 7 is moved initially briefly at a reduced speed, because the control valve means associated with the working chamber being vented are held in the hold setting 31 by the further actuating means until the output drive unit has cleared the response range of the responsive means 48 and, respectively, 49.

As long as the output drive unit 7 dwells in the response range of the responsive means 48 or 49, the associated control valve means 25 and 26 assume the hold setting 31 irrespectively of the working pressures obtaining of the working chambers 12 and 13. The switching setting is in this case set in a fashion dependent on the position of the output drive unit 7. It is only clear of this response range that the switching of the position of the control valve means 25 and 26 is controlled in a pressure dependent manner between the air economy setting 30 and the high power setting.

As already hinted at least the two control valve means 25 and 26 may be designed as a unitary subassembly with the pneumatic drive 2. Furthermore, the direction setting valve 16 can be a component of this subassembly.

The pneumatic drive system 1 may comprise more than the one pneumatic drive 2, each pneumatic drive then preferably having its own first and second control valve means 25 and 26.

The direction setting valve 15 may on the contrary serve for the simultaneous operation of several parallel-connected pneumatic drives 2.

Departing from the working example the control valve means 25 and 26 associated with the one pneumatic drive 2 may be present in the singular. They are then preferably either on the first control line 14 or on the second control line 15 dependent on which stroke direction is associated with the functionality which is strived at.

The invention claimed is:

1. A pneumatic drive system comprising at least one pneumatic drive having a drive housing and an output drive unit able to be shifted in relation to it by the action of compressed air, said output drive unit possessing an output piston, which in the drive housing divides two working chambers from each other, of which one or both is connected with control valve means serving for the controlled action of compressed air, said control valve means being able to be switched over between several switching settings which include an air economy setting defining a choke cross section, wherein, as a further switching setting, the control valve means have a high power setting which sets a flow cross section which is larger than the choke cross section, and wherein actuating means are associated with the control valve means which, during the supply of compressed air into one working chamber, so control the switching over of the control valve means connected to this working chamber in a fashion dependent on the air pressure obtaining in at least one working chamber that a switching over takes place from the normally assumed air economy setting into the high power setting, when and at least as long as the output drive unit is subjected to a increased resistance to motion, and wherein the control valve means, as a further switching setting, have a hold setting predetermining a flow cross section smaller than the choke cross section, and wherein further actuating means are associated with the control valve means which are able to be activated in a fashion dependent on the position of the output drive unit, such further actuating means being able to cause a switch over into the hold setting, when in the course of its working stroke, the output drive unit reaches an end of stroke position or a position just short thereof.

2. The drive system as set forth in claim 1, wherein the at least one pneumatic drive is a linear drive.

3. The drive system as set forth in claim 1, wherein the at least one pneumatic drive is a pneumatic cylinder, whose output drive unit comprises a piston rod extending terminally from the drive housing.

4. The drive system as set forth in claim 3, wherein the pneumatic cylinder is a crust breaker cylinder, on whose piston rod a suitable hammer element is terminally arranged for penetrating the crust of a metallic melt.

5. The drive system as set forth in claim 1, wherein the actuating means are so designed that they cause a switch over of the control valve means in a fashion dependent on the air pressure obtaining in the working chamber connected with the control valve means.

6. The drive system as set forth in claim 5, wherein the actuating means are so designed that they switch over the control valve means from the air economy setting so far assumed into the high power setting when the air pressure obtaining in the working chamber connected with such control valve means has risen to a predetermined switch over threshold value.

7. The drive system as set forth in claim 5, wherein the control valve means include a control valve member defining the switch over setting of the control valve means by its currently assumed setting, to which control valve member the input pressure is supplied for acting toward the air economy setting and the output pressure is supplied for acting toward the high power setting, said control valve member being additionally acted on by spring means acting toward the high power setting.

8. The drive system as set forth in claim 7, wherein the spring means may be adjusted as regards their setting force.

9. The drive system as set forth in claim 7, wherein a choke means is placed on the actuating duct supplying the output pressure to the control valve member, said choke means causing a time delayed build up of pressure force at the control valve member.

10. The drive system as set forth in claim 1, wherein, upstream from the control valve means, a direction setting valve is placed connected or able to be connected with a compressed air source in the form of a 5/2 directional valve, such direction setting valve being in a position to supply with compressed air and to vent the two working chambers in alternate mutually opposite succession.

11. The drive system as set forth in claim 1, wherein the further actuating means comprise response means responsive to a predetermined position of the output drive unit and thereby causing the switching over into the hold setting.

12. The drive system as set forth in claim 11, wherein the response means comprise at least one preferably plunger-like setting member extending into the stroke path of the output drive unit.

13. The drive system as set forth in claim 1, wherein, for setting its switching settings, the control valve means comprise a control valve member able to be selectively put in one of three positions.

14. The drive system as set forth in claim 1, wherein the flow cross section available for flow in the hold setting of the control valve means has a size which predetermines a flow rate at least equal to the leakage occurring in the pneumatic drive and preferably is within the range of such leakage.

* * * * *